United States Patent [19]

Bridges

[11] Patent Number: 4,607,691

[45] Date of Patent: Aug. 26, 1986

[54] NON-ORIENTING, MULTIPLE PORTED, CYLINDRICAL PRESSURE TRANSFER DEVICE

[75] Inventor: Charles D. Bridges, Houston, Tex.

[73] Assignee: Combustion Engineering, Inc., Windsor, Conn.

[21] Appl. No.: 628,671

[22] Filed: Jul. 6, 1984

[51] Int. Cl.[4] ..... E21B 33/03

[52] U.S. Cl. ..... 166/88; 285/137.2; 285/93

[58] Field of Search ..... 166/88, 95, 75 R, 341, 166/344; 285/137 A, 137 R

[56] References Cited

U.S. PATENT DOCUMENTS 4,090,565 5/1978 McGee ..... 285/137 A X 4,458,903 7/1984 Tohill ..... 285/137 A

*Primary Examiner*—Stephen J. Novosad
*Assistant Examiner*—Thuy M. Bui

[57] ABSTRACT

A production tubing for an oil well is supported by two solid structures at the wellhead. A downhole valve is controlled through pressure of a hydraulic fluid provided by a ground-level source connected to the downhole valve through a penetrating conduit formed in three segments. The first segment is formed by drilling a passage through the upper structure which communicates with a passage provided in a sleeve clamped between the two structures. The third segment is provided by drilling a passage through the lower structure which communicates with the passage provided in the sleeve.

4 Claims, 3 Drawing Figures

NON-ORIENTING, MULTIPLE PORTED, CYLINDRICAL PRESSURE TRANSFER DEVICE

TECHNICAL FIELD

The present invention relates to providing fluid pressure communication from ground level to a downhole safety valve through a tubing head bonnet and a tubing hanger.

BACKGROUND ART

In the final assembly of an oil or gas producing well, the production tubing is generally provided with a subsurface safety valve located a distance below the wellhead assembly. Thus, there is necessity and/or requirement to provide an independent fluid pressure passage through the wellhead equipment, i.e., tubing head bonnet and tubing hanger, to allow manipulation of the subsurface valve. Small bore tubing is connected to the passageway provided between the bonnet and hanger and down to the safety valve to be actuated. Passages through the bonnet and hanger are precisely drilled and must be aligned as the parts are brought together. If alignment at their mating surfaces is not achieved, reorientation for proper alignment is difficult and expensive.

Fluid pressure passageways may be provided by other means. For example, inward through a tubing head outlet, through the tubing hanger, and down the control line to the safety valve. Again, proper alignment between the hanger and outlet must be accomplished or fluid pressure injection problems are encountered.

A structure is needed that will eliminate the problem of alignment and that will provide passageways that are sealed in a metal-to-metal configuration. However, the problem solved by the invention extends beyond the oil well art.

DISCLOSURE OF THE INVENTION

The present invention contemplates a cylindrical sleeve mounted between the mating surfaces of a pair of solid bodies such as an upper tubing head bonnet and a lower tubing hanger, and coaxial with the passages for the production of fluids through the bonnet and hanger. The sleeve which is coaxial with the production passageways in the bonnet and hanger is provided tapered surfaces at each end which align with recesses in the bonnet and hanger. At least one groove will be provided in the tapered surfaces of the sleeve so that when the slanted surfaces are nested into the recesses in the bonnet and hanger, the passageways drilled through the bonnet and hanger will communicate with the grooves with any circular orientation of the sleeve and bonnet and hanger.

Other objects, advantages and features of this invention will become apparent to one skilled in the art upon consideration of the written specification, appended claims, and attached drawings.

BRIEF DESIGNATION OF THE DRAWINGS

BEST MODE FOR CARRYING OUT THE INVENTION

The System in General

In the preferred embodiment of the invention, a cylindrical sleeve is placed between the bonnet and the hanger, and coaxial with their production passages. The simple objective is to establish fluid pressure communication through the upper bonnet structure and the lower hanger structure. With this communication for high pressure fluid from a source of pressure fluid, tubing may be extended from the hanger to subsurface safety valves, or other structure needing actuation downhole. The upper bonnet and the lower hanger are clamped together in the present art so as to register holes drilled through the bonnet and hanger as a penetration. The present invention proposes that a structure embodying the invention be placed between the bonnet and hanger. This inventive embodiment, in the form of a cylindrical sleeve, is mechanically extended between the mating surface of bonnet and hanger, while coaxial with their central production passages. A hole drilled through the bonnet communicates with a conduit in the cylindrical sleeve. A hole is similarly drilled through the hanger structure. Communication is provided between the hole in the bonnet and the hole in the hanger in any orientation between the bonnet and hanger.

The cylindrical sleeve has circular grooves on its upper and lower ends. These grooves are communicated by a drilled hole in the wall between the upper and lower grooves. Each end of the sleeve is formed into a taper which provides two surfaces on each end of the sleeve. When the sleeve is placed between the bonnet and hanger, each end is accommodated by a recess in the bonnet and hanger which receives the tapered ends of the sleeve. The solid sides of the recesses in the bonnet and hanger seal over the grooves in the tapered surfaces of the sleeve to form circular passageways for the fluid pressure to be transmitted. The result is a continuous passage available to a source of high pressure fluid. This passageway begins with the passageways drilled in the bonnet, the lower end of the passageway in the bonnet communicates with the circular passageway in the upper end of the sleeve and continues with a passageway provided between the upper circular passageway and the lower circular passageway. Finally, the passageway through the hanger communicates with the lower circular passageway in the sleeve. Tubing properly mounted in the lower end of the passageway through the hanger can be taken downhole to actuate subsurface safety valves, or other equipment responsive to high pressure fluid.

Figure 2:
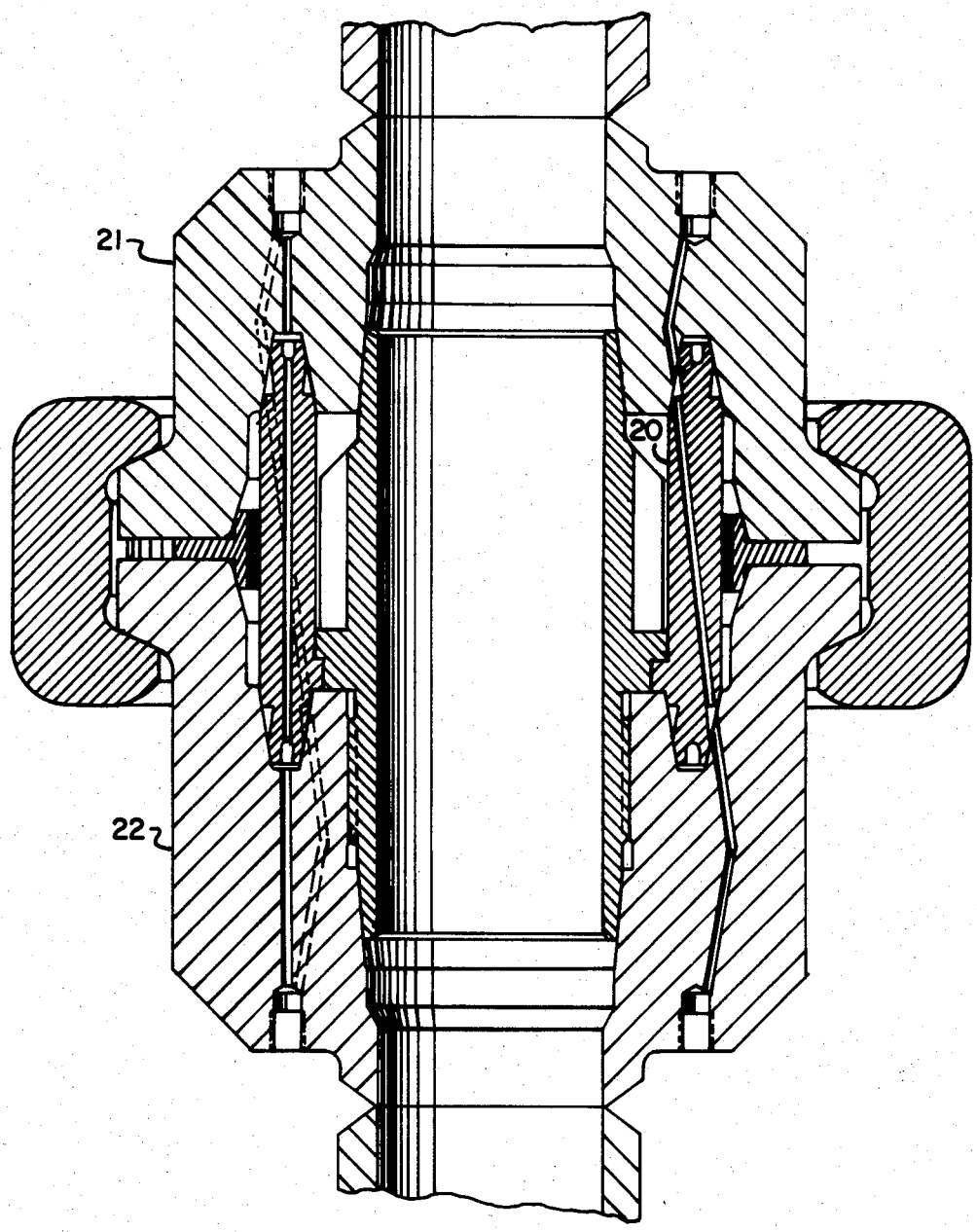
FIG. 2 is a cross-sectioned elevation of the sleeve of FIG. 1 in a different environment.

Although the present invention is well illustrated in association with the bonnet and hanger carried on the upper end of oil well production tubing, it is applicable to other environments, such as illustrated in FIG. 2. More specifically, where there are solid fixtures through which fluid pressure is to be transmitted, the present invention embodied in a cylindrical sleeve may be positioned between the solid fixtures to become part of the conduit extending through each fixture. A source of fluid pressure will have an unobstructed route provided in order to apply the fluid pressure through the fixtures to a designated point beyond.

FIG. 1

The solid fixtures on the upper end of the production tubing of an oil well are disclosed in the drawings. The fixtures through which the tubing withdraws production are usually landed on the upper end of the casing in the wall. Up to the present, the fixtures have been drilled to provide a passageway for a source of fluid pressure which actuates the subsurface valves. However, registration of drilled holes is very difficult. The embodiment of the present invention eliminates the need of precise registration. The apparatus associated with the upper end of production tubing of an oil well has been disclosed in FIG. 1.

Figure 1:
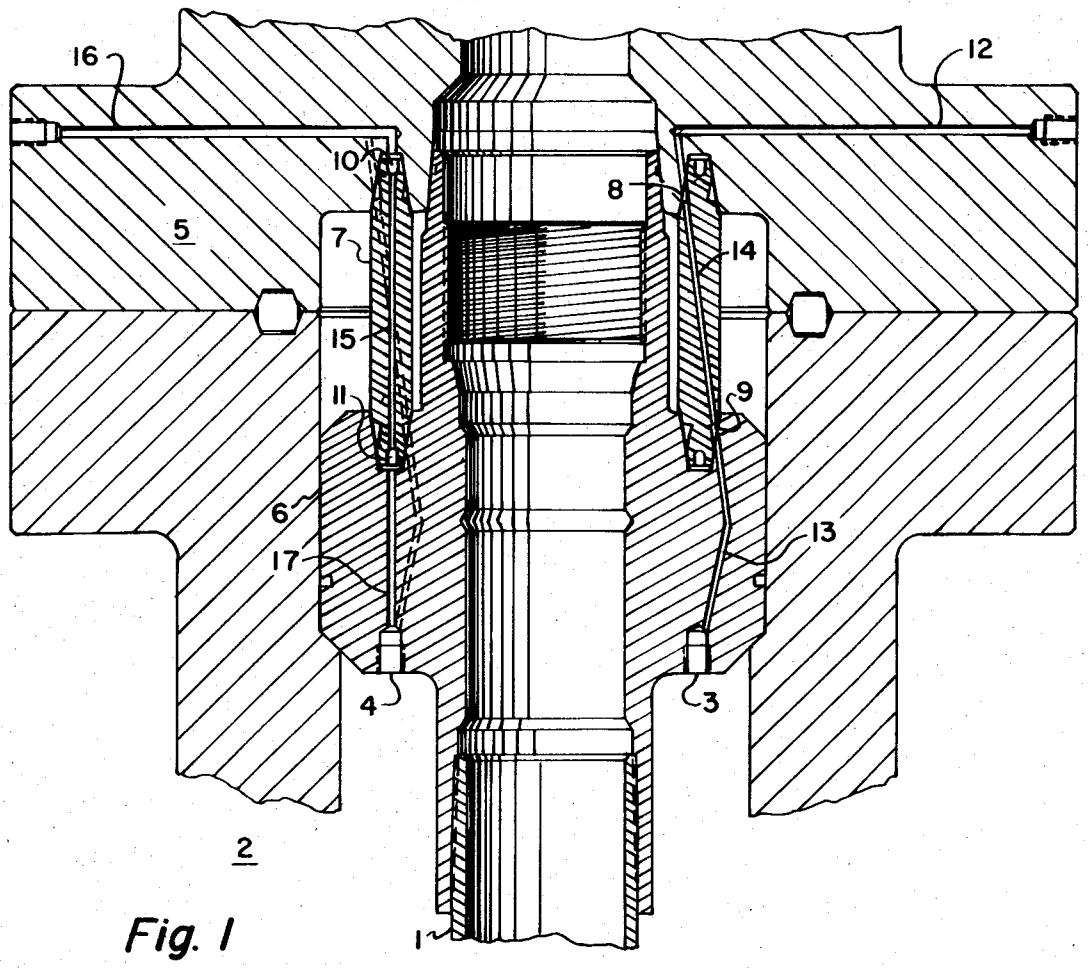
FIG. 1 is a cross-sectioned elevation of a cylindrical sleeve mounted between parallel surfaces of a tubing head bonnet and tubing hanger embodying the present invention.

The production tubing 1 extends down the well through a casing 2. In this position of the production tubing fixtures, a passageway is required through the fixtures in order to communicate a source of fluid pressure with such devices as downhole valves. FIG. 1 illustrates arrangements for passageways to communicate fluid pressure with more than one safety valve. With two valves installed in the production tubing, control tubing 3 is connected to the lower end of one passageway and is extended downward to one valve. Control tubing 4 is connected to the lower end of another passageway and is extended downward to a second valve.

In the present practice, holes drilled into a bonnet 5 and hanger 6 offset from the axial passageway of the hanger and bonnet must be precisely aligned. The embodiment of the present invention eliminates this difficult alignment. A cylindrical sleeve 7 is tapered at each end for reception in recesses in bonnet 5 and hanger 6. The slanted and flat, perpendicular surfaces on each end of the sleeve have circular grooves 8, 9, 10 and 11 formed in them. Grooves 8 and 9 communicate with passageways 12 and 13 in the bonnet and hanger by means of a drilled hole 14 in the sleeve wall. Thus, a complete passageway is formed for fluid pressure and communication with control tubing 3 is completed through a passageway formed by 12, 8, 14, 9 and 13.

Under the concepts of the invention, grooves 10 and 11 formed in the surfaces perpendicular to the axis of the sleeve, communicate with a drilled passageway 15 in the sleeve wall. Hole 15 receives fluid pressure from passageway 16 through groove 10 and transmits the pressure through groove 11 to passageway 17 which connects with downhole control tubing 4.

Other Environment

FIG. 1 discloses the environment for the present invention is the tubing bonnet and hanger at the head of an oil well; however, the present invention must be defined so as not to preclude other environments in which the invention may successfully function. FIG. 2 serves this purpose. As an example, the components of a Grayloc connector, marketed by Gray Tool Company, requiring penetration is disclosed in FIG. 2. A sleeve 20 is clamped between two bodies 21 and 22 of the Grayloc connector through which one or more penetrations are required. Except for the two bodies of the Grayloc connector requiring penetration, the invention is embodied as in the structure disclosed in FIG. 1.

Sleeve 20 is provided with a plurality of surfaces at each end. Each surface of the sleeve may have a circular groove and a hole is drilled in the wall between the grooves on each end of the sleeve exactly as disclosed in FIG. 1. The bodies of the Grayloc connector requiring penetration have recesses formed to receive each end of sleeve 20. Passageways are provided in each portion of the Grayloc connector that communicate with each other through the grooves and wall passages of sleeve 20; therefore, wherever communication is required for fluid pressure through any fixtures such as represented by the Grayloc connector, the invention as embodied in sleeve 20 provides this communication under the concepts of the present invention.

Sleeve Resiliency

Figure 3:
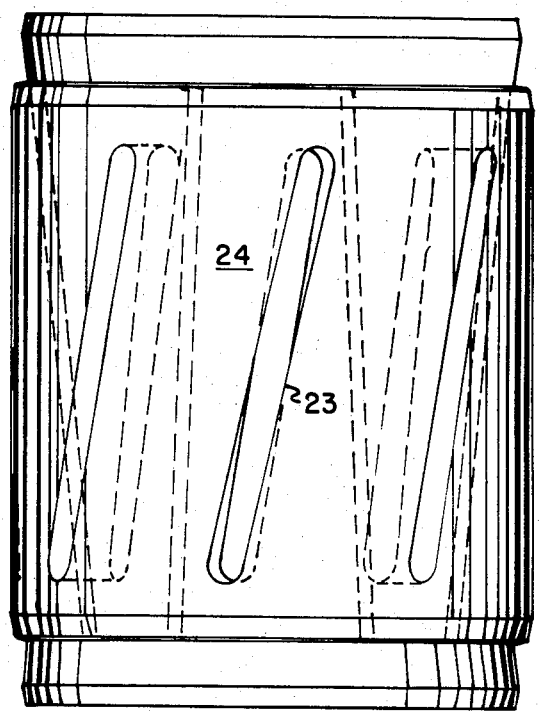
FIG. 3 is a sectioned elevation of the sleeve of FIG. 1 with slots in its wall.

In order to provide spring-like resiliency for sleeves 7 and 20, equally spaced helical slots 23 are formed through the sleeve wall at an angle to the axis of the sleeve to produce a series of cantilevered energy members 24 which provide end-to-end elasticity, as shown in FIG. 3. This elasticity provides a tolerance on make-up and produces a degree of stored energy to maintain the required gasket factor necessary for metal-to-metal sealing without plastic deformation of the part.

Conclusion

The problem was generated by the requirement for a penetration through two solid bodies which have heretofore been clamped together. The conduit drilled through one body had to be aligned with the similar conduit drilled in the other body. The general requirement was to align or register the two conduits in the solid bodies when the bodies were clamped together. Unfortunately, registration of the mating ends of each conduit is difficult. Some structure was required between the two solid bodies to eliminate the problem of registration. The invention is found in the sleeve structure captured between the two solid bodies to eliminate the precise registration of the conduits formed in the bodies. If a circular groove is formed on each end of a cylindrical sleeve clamped between the two solid bodies, these circular grooves are converted into conduits or passageways.

The invention is refined by providing tapered or slanting surfaces on each end of the sleeve which will have additional annular grooves formed in their surfaces. Of course, each set of circular grooves is communicated with each other by a hole drilled through the wall of the sleeve. Thus, separate passageways are provided, isolated from each other.

From the foregoing, it will be seen that this invention is one well adapted to attain all the ends and objects hereinabove set forth, together with other advantages which are obvious and inherent to the apparatus.

It will be understood that certain features and subcombinations are of utility and may be employed without reference to other features and subcombinations. This is contemplated by and is within the scope of the invention.

As many possible embodiments may be made of the invention without departing from the scope thereof, it is to be understood that all matter herein set forth or shown in the accompanying drawings is to be interpreted in an illustrative and not in a limiting sense.

I claim:

1. A system for conducting a fluid pressure through bonnet and hanger supports for a tubing in well bore, including, a tubing bonnet at the top of the well, a hanger arranged to support the well tubing, at least one conduit formed through the bonnet and the hanger, a source of fluid pressure connected to the upper end of the conduit through the tubing bonnet, a cylindrical sleeve captured coaxially between the production passageways of the tubing bonnet and hanger, a first circular groove formed in the upper end of the sleeve to communicate with the lower end of the conduit formed through the bonnet, a second circular groove formed in the lower end of the sleeve to communicate with the upper end of the conduit formed through the tubing hanger, a drilled hole formed in the wall of the sleeve communicating the upper and lower circular grooves, and tubing extended from the hanger conduit to operate downhole structure with the fluid pressure.

2. The system of claim 1, wherein, the upper and lower ends of the sleeve are tapered, the tubing bonnet engages the upper tapered end of the sleeve in a recess having flared sides to seal a tapered surface of the sleeve and thereby form a circular passageway with the groove in the sleeve, and the tubing hanger engages the lower tapered end of the sleeve in a recess having flared sides to seal a tapered surface of the sleeve and thereby form a second circular passageway with the groove in the sleeve.

3. A system for conducting a fluid pressure through the upper and lower solid bodies of a support structure for tubing in a well bore, including, at least one conduit formed through the solid bodies, a source of fluid pressure connected to the upper end of the conduit through the upper solid body and coaxial with the passageways through the solid body, a cylindrical sleeve captured between the solid bodies and having equally spaced helical slots formed through the the sleeve wall at an angle to the sleeve axis to form a series of cantilevered energy members to provide end-to-end elasticity in the sleeve, a first circular groove formed in the upper end of the sleeve to communicate with the lower end of the conduit formed through the upper solid body, a second circular groove formed in the lower end of the sleeve to communicate with the upper end of the conduit formed through the lower solid body, a drilled hole formed in the wall of the sleeve communicating with the upper and lower circular grooves, and tubing extending from the lower solid body conduit to operate downhole structure with the fluid pressure.

4. The system of claim 3, wherein, the upper and lower ends of the sleeve are tapered, the upper solid body engages the upper tapered end of the sleeve in a recess having flared sides to seal a tapered surface of the sleeve and thereby form a circular passageway with the groove in the sleeve, and the lower solid body engages the lower tapered end of the sleeve in a recess having flared sides to seal a tapered surface of the sleeve and thereby form a second circular passageway with the groove in the sleeve.

* * * * *